US011493285B2

(12) United States Patent
Noël-Baron

(10) Patent No.: US 11,493,285 B2
(45) Date of Patent: Nov. 8, 2022

(54) BAFFLE SUPPORT AND BAFFLE

(71) Applicants: Alfa Laval Corporate AB, Lund (SE); Alfa Laval Vicarb SAS, Fontanil-Cornillon (FR)

(72) Inventor: Olivier Noël-Baron, Echirolles (FR)

(73) Assignees: ALFA LAVAL CORPORATE AB, Lund (SE); ALFA LAVAL VICARB SAS, Fontanil-Cornillon (FR)

( * ) Notice: Subject to any disclaimer, the term of this patent is extended or adjusted under 35 U.S.C. 154(b) by 0 days.

(21) Appl. No.: 16/645,968

(22) PCT Filed: Sep. 4, 2018

(86) PCT No.: PCT/EP2018/073739
§ 371 (c)(1),
(2) Date: Mar. 10, 2020

(87) PCT Pub. No.: WO2019/052857
PCT Pub. Date: Mar. 21, 2019

(65) Prior Publication Data

US 2020/0278159 A1 Sep. 3, 2020

(30) Foreign Application Priority Data

Sep. 15, 2017 (EP) ..... 17191226

(51) Int. Cl.
*F28F 9/007* (2006.01)
*F28F 3/08* (2006.01)
*F28F 9/22* (2006.01)

(52) U.S. Cl.
CPC ..... *F28F 9/0075* (2013.01); *F28F 3/08* (2013.01); *F28F 2009/226* (2013.01); *F28F 2280/00* (2013.01)

(58) Field of Classification Search
CPC .. F28F 2009/226; F28F 9/0212; F28F 9/0268; F28F 2009/224; F28F 9/0217;
(Continued)

(56) References Cited

U.S. PATENT DOCUMENTS 1,635,838 A * 7/1927 Haber ..... F28F 3/083 165/166
RE16,807 E * 12/1927 Haber ..... F28F 3/083 165/95

(Continued)

FOREIGN PATENT DOCUMENTS

CN 103459966 A 12/2013
CN 104180704 B 1/2016

(Continued)

OTHER PUBLICATIONS

Office Action (First Examination Report) dated Apr. 1, 2021, by the Patent Office, Government of India, in corresponding India Patent Application No. 202017015181 with an English Translation of the Office Action. (4 pages).

(Continued)

*Primary Examiner* — Jianying C Atkisson
*Assistant Examiner* — Jose O Class-Quinones
(74) *Attorney, Agent, or Firm* — Buchanan Ingersoll & Rooney PC

(57) ABSTRACT

A baffle support and a baffle for a block-type heat exchanger. The baffle support comprises a base plate extending in a first direction and a transverse second direction. The baffle support comprises a first pair and a second pair of projections extending from the front surface of the base plate to engage the baffle. The first pair of projections is located further in the first direction than the second pair of projections. The baffle comprises a mounting member at each transverse edge of a baffle plate. Each mounting member
(Continued)

comprises at least one stop surface) facing a first longitudinal edge of the baffle plate. A baffle assembly comprising two baffle supports and a baffle.

19 Claims, 7 Drawing Sheets

(58) Field of Classification Search
CPC .... F28F 3/083; F28F 3/10; F28F 9/002; F28F 9/10; F28F 9/12; F28F 2225/00; F28F 2230/00; F28F 2275/14; F28F 2280/06; F28F 2280/00; F28F 9/0075; F28F 3/08
USPC ..... 165/165–166, 159–161
See application file for complete search history.

(56) References Cited

U.S. PATENT DOCUMENTS 1,768,786 A * 7/1930 Potter ..... F28F 9/00 165/161
2,182,338 A * 12/1939 Gurlik ..... F28F 9/0212 165/150
2,252,916 A * 8/1941 Crosby ..... B01D 25/343 165/78
2,770,954 A * 11/1956 Jansen ..... F25D 17/045 62/276
2,804,832 A * 9/1957 Mahoney ..... A21B 1/46 432/141
2,953,110 A * 9/1960 Etheridge ..... F28D 9/0025 29/890.03
3,165,624 A * 1/1965 Cunningham ..... F24H 3/002 392/353
3,404,785 A * 10/1968 Emary ..... H05K 7/14 211/183
3,605,874 A * 9/1971 Brunell ..... F28D 19/044 165/9
3,856,374 A * 12/1974 Christen ..... A23B 4/052 312/263
3,923,098 A * 12/1975 Ares ..... F25D 21/14 165/111
4,314,607 A * 2/1982 DesChamps ..... F28D 9/0025 165/166
4,733,722 A * 3/1988 Forbes ..... F28F 9/00 165/159
4,778,005 A 10/1988 Smith
5,022,465 A * 6/1991 Baines ..... F28F 9/0212 165/158
5,339,891 A 8/1994 Kidaloski et al.
5,341,872 A * 8/1994 Mercurio ..... F28F 9/0212 165/173
5,586,600 A * 12/1996 Cribari ..... F28F 9/0243 165/173
5,681,538 A * 10/1997 Sung ..... B01J 19/249 165/166
6,068,050 A * 5/2000 Ghiani ..... F28D 1/0535 165/174
6,202,570 B1 * 3/2001 Kurtsman ..... H02B 1/34 108/108
6,234,238 B1 * 5/2001 Koyama ..... F28D 1/05375 165/133
6,311,768 B1 * 11/2001 Jamison ..... F28D 1/0316 165/173
6,332,495 B1 * 12/2001 Jamison ..... F28D 1/0316 165/148
7,523,903 B1 * 4/2009 Rindoks ..... A47B 96/028 211/187
7,874,349 B2 * 1/2011 Duong ..... F28F 9/002 165/173
2003/0019615 A1 * 1/2003 Igami ..... F28F 9/0212 165/143
2003/0213587 A1 * 11/2003 Mano ..... B60K 6/40 165/174
2005/0194120 A1 9/2005 Lomax, Jr. et al.
2005/0211425 A1 * 9/2005 McKittrick ..... F28F 9/0243 165/174
2007/0062215 A1 * 3/2007 Yamazaki ..... F28F 9/0251 62/509
2007/0074860 A1 * 4/2007 Shinhama ..... F28F 9/0224 165/173
2010/0025028 A1 * 2/2010 Shinhama ..... F28F 9/0246 165/174
2012/0267088 A1 * 10/2012 Lange ..... F28D 15/0233 165/181
2013/0299146 A1 11/2013 Blomgren
2014/0305620 A1 10/2014 Heinio
2014/0311718 A1 * 10/2014 Nilsson ..... F28F 3/08 165/133
2015/0075757 A1 3/2015 Blomgren et al.
2015/0076097 A1 * 3/2015 Powers ..... H04Q 1/02 211/183
2015/0096718 A1 4/2015 Noel-baron
2016/0356532 A1 * 12/2016 Wijaya ..... F28D 1/05391
2017/0023311 A1 * 1/2017 Urbanski ..... F28D 9/0037
2017/0211895 A1 7/2017 Frechette et al.
2018/0112935 A1 4/2018 Seo

FOREIGN PATENT DOCUMENTS

CN 104197768 B 2/2016
CN 105466257 A 4/2016
CN 205607222 U 9/2016
CN 205682825 U 11/2016
EP 0165179 B1 9/1987
EP 1 046 876 A2 10/2000
EP 2508831 A1 10/2012
EP 2594884 A1 5/2013
EP 2597412 A1 5/2013
EP 2672215 A1 12/2013
JP 60256792 A 12/1985
JP 2007-526433 A 9/2007
JP 2014-533820 A 12/2014
KR 20-2000-0008377 U 5/2000
KR 10-1733934 B1 5/2017
WO 9322608 A1 11/1993
WO 2013/079332 A1 6/2013

OTHER PUBLICATIONS

An English Translation of the Office Action (Notice of Preliminary Rejection) dated May 28, 2021, by the Korean Intellectual Property Office in corresponding Korean Patent Application No. 10-2020-7010668. (2 pages).
An English Translation of the Office Action (Notice of Reasons for Rejection) dated Apr. 19, 2021, by the Japanese Patent Office in corresponding Japanese Patent Application No. 2020-515117. (3 pages).
International Search Report (PCT/ISA/210) dated Nov. 30, 2018, by the European Patent Office as the International Searching Authority for International Application No. PCT/EP2018/073739.
Written Opinion (PCT/ISA/237) dated Nov. 30, 2018, by the European Patent Office as the International Searching Authority for International Application No. PCT/EP2018/073739.
Anonymous: "Compablock—compact performance", "" Retrieved from the Internet:URL:https://web.archive.org/web/20150824062244/https://www.alfalaval.com/globalassets/documents/products/heat-transfer/plate-heat-exchangers/welded-plate-and-block-heat-exchangers/product-brochure---compact-performance.pdf [retrieved on May 28, 2018] Aug. 24, 2015.
An English Translation of the First Office Action dated Dec. 24, 2020, by the National Intellectual Property Administration, P. R. China in corresponding Chinese Patent Application No. 201880059695.7. (5 pages).

(56) References Cited

OTHER PUBLICATIONS

Office Action (Communication pursuant to Article 94(3) EPC) dated Mar. 10, 2022, by the European Patent Office in corresponding European Patent Application No. 17 191 226.4-1002. (6 pages).

* cited by examiner

BAFFLE SUPPORT AND BAFFLE

TECHNICAL FIELD

The invention relates to attachment of a baffle in a block-type heat exchanger.

BACKGROUND ART

Today several different types of plate heat exchangers exist and are employed in various applications depending on their type. One certain type of plate heat exchanger is assembled by bolting a top head, a bottom head and four side panels to a set of corner girders to form a box-like enclosure around a stack of heat transfer or heat exchanging plates. This certain type of plate heat exchanger is referred to as a block-type heat exchanger. One example of a commercially available block-type heat exchanger is the heat exchanger offered by Alfa Laval AB under the product name Compabloc. Other block-type plate heat exchangers are disclosed in patent documents EP 165179 and WO 93/22608.

In the block-type plate heat exchanger fluid paths for two heat exchange fluids are formed between the heat transfer plates in the stack of heat transfer plates, in order to transfer heat between the two heat exchange fluids. Fluid inlets and fluid outlets are typically arranged on the side panels while baffles are attached to and arranged at the sides of the stack of heat transfer plates for directing a fluid back and forth through the fluid paths formed between heat transfer plates. The baffles are arranged in a space formed between the stack of heat transfer plates and the side panels. The corner girders are typically covered by girder linings protecting the corner girders from the heat exchange fluids. A so-called vacuum cage may be provided along the girder linings in the space formed between the stack of heat transfer plates and the side panels.

One type of baffle, which is employed in the above mentioned Compabloc heat exchanger, comprises two corrugated plates welded together. Each of the plates comprises a fold along one longitudinal edge of the baffle, which folds of the two plates together form a fork-like shape engaging the heat transfer plates. Each of the plates also comprises a fold along the opposite longitudinal edge of the baffle, which folds have been folded somewhat less than 90° for pressing and sealing against the side panel. Each of the plates also comprises folds along the transversal edges, which folds are welded to the girder lining or vacuum cage.

The existing baffles are heavy, expensive to manufacture and complicated to install and remove.

Hence, there is a need for an improvement of the mounting of a baffle in a block-type heat exchanger.

SUMMARY

One object of the invention is to improve the attachment of a baffle in a block-type heat exchanger. One object of the invention is to provide an improved baffle assembly. One object of the invention is to provide an improved baffle. One object of the invention is to facilitate and improve maintenance of a block-type heat exchanger. One object of the invention is to facilitate assembly of a baffle and/or a baffle assembly. One object of the invention is to facilitate disassembly of a baffle and/or a baffle assembly. One object of the invention is to enable disassembly of a baffle and/or a baffle assembly. One object of the invention is to provide releasability of a baffle in a block-type heat exchanger. One object of the invention is to enable easy disassembly of a baffle and/or a baffle assembly. One object of the invention is to provide a strong baffle assembly. One object of the invention is to provide a strong and rigid attachment of a baffle in a block-type heat exchanger.

These and further objects are achieved by a baffle support arranged to be attached to an inner side wall of a block-type heat exchanger for holding a baffle in the heat exchanger. The baffle support comprises a base plate defining a base plane extending in a first direction and a second direction transverse to the first direction. The base plate has a front surface and a back surface. The baffle support comprises a first pair of projections extending from the front surface of the base plate to engage the baffle and a second pair of projections extending from the front surface of the base plate to engage the baffle. The first pair of projections is located further in the first direction than the second pair of projections.

The baffle support with projections enables easy mounting of a baffle to the baffle support in a heat exchanger. The baffle support with projections enables easy disassembly and removal of a baffle from a heat exchanger and the baffle support. The baffle support with projections facilitates maintenance of a block-type heat exchanger. The baffle support with pairs of projections provides a strong and rigid attachment of a baffle in a heat exchanger and thus a strong and rigid baffle assembly. baffle support with pairs of projections provides a distinct mounting of the baffle and reduces the risk of leakage and deformation of the stack of heat transfer plates.

The above and further objects as well as the above advantages and effects are also achieved by a baffle for a block-type heat exchanger. The baffle comprises a baffle plate. The baffle plate comprises a first baffle surface and a second baffle surface. The baffle plate comprises a first longitudinal edge, a second longitudinal edge, a first transverse edge and a second transverse edge. The baffle comprises a mounting member at each transverse edge for mounting the baffle to a baffle support. Each mounting member comprises at least one stop surface facing the first longitudinal edge.

The above and further objects as well as the above advantages and effects are also achieved by a baffle assembly for a block-type heat exchanger comprising two baffle supports as described above and a baffle as described above.

Still other objectives, features and advantages of the baffle support, the baffle and the baffle assembly will appear from the following detailed description as well as from the drawings.

BRIEF DESCRIPTION OF THE DRAWINGS

Embodiments of the invention will now be described with reference to the accompanying schematic drawings, in which.

DETAILED DESCRIPTION

Figure 1:
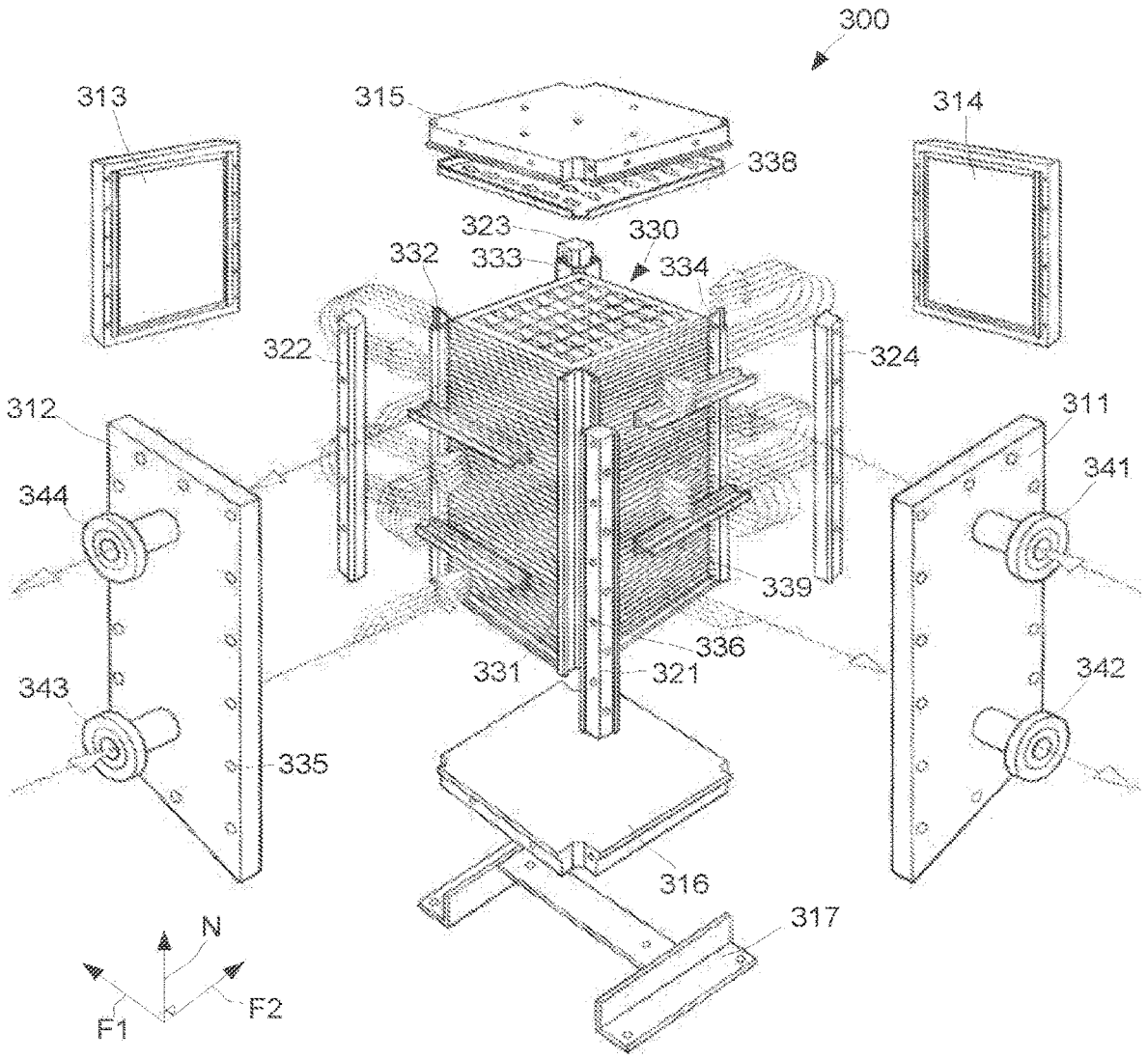
Fig. 1 PRIOR ART
FIG. 1 is an exploded view of a block-type heat exchanger with baffles according to prior art.

With reference to FIG. 1 a plate heat exchanger 300 of a block-type having conventional baffles welded to girder linings is shown. The plate heat exchanger 300 comprises a top head 315, a bottom head 316 and four side panels 311, 312, 313, 314 that are bolted together with a set of four corner girders 321-324 for assembling the plate heat exchanger 300. When assembled, the plate heat exchanger 300 has a box-like or block-like shape and an enclosure is formed by the top head 315, the bottom head 316 and the side panels 311-314. A stack of heat transfer plates 330 is arranged within the enclosure and comprises a number of pairs of heat transfer plates. The stack of heat transfer plates 330 also has a box-like or block-like shape, which shape corresponds to the shape of the enclosure formed by the heads 315, 316 and the side panels 311-314. The stack of heat transfer plates 330 has at its corners four girder linings 331-334 that are arranged to face the corner girders 321-324. The plate heat exchanger 300 also has a base 317 that facilitates attachment of the plate heat exchanger 300 to the ground.

Gaskets (not shown) are arranged on the side panels 311-314 at sections that face the corner girders 321-324 and the heads 315, 316, such that the enclosure formed by the heads 315, 316 and side panels 311-314 is properly sealed for preventing leakage from the plate heat exchanger 300.

A first side panel 311 and a second side panel 312 of the side panels 311-314 comprise inlets and outlets for two fluids. In detail, the first side panel 311 has an inlet 341 and an outlet 342 for a first fluid. The inlet 341 and outlet 342 of the first panel 311 form a flow path for the first fluid in combination with the stack of heat transfer plates 330, where the flow path extends from the inlet 341, within the stack of heat transfer plates 330 and to the outlet 342. This flow path is illustrated by the broken arrows that extend in directions parallel to the direction F1. Baffles, such as conventional baffle 339, are connected to sides of the stack of heat transfer plates 330 for directing the flow of the first fluid in a number of passes within the stack 330 (four passes in the illustrated FIG. 1 having two baffles on each side).

The second side panel 312 has an inlet 343 and an outlet 344 for a second fluid. The inlet 343 and outlet 344 of the second side panel 312 form a flow path for the second fluid in combination with the stack of heat transfer plates 330, where the flow path extends from the inlet 343, within the stack of heat transfer plates 330 and to the outlet 344. This flow path is illustrated by the broken arrows that extend in directions parallel to the direction F2. Baffles, such as conventional baffles 339, connected to sides of the stack of heat transfer plates 330 direct the flow of the second fluid in a number of passes within the stack 330 (here the same number of passes as for the first fluid).

The first flow path for the first fluid is between the pairs of heat transfer plates in the stack 330, while the second flow path for the second fluid is within the pairs of heat transfer plates in the stack 330. A pair of heat transfer plates comprises a first heat transfer plate and a second heat transfer plate. This means that the flow of the first fluid is between heat transfer plates of different pairs of heat transfer plates, while the flow of the second fluid is between a first and a second heat transfer plate of the same pair, i.e. within a pair. The girder linings 331-334 seal the corners of the stack of heat transfer plates 330, which ensures that the two different fluids paths are separated.

The assembly of the plate heat exchanger 300 is typically performed by using conventional methods and bolts (not shown) that attach the mentioned components to each other via bolt holes like holes 335 and 336. In brief, assembling the plate heat exchanger 300 includes arranging the stack of heat transfer plates 330 on the bottom head 316, sliding the corner girders 321-324 into the girder linings 331-334 and bolting them to the bottom head 316. A channel end plate 338 is arranged on top of the stack of heat transfer plates 330 and the top head 315 is bolted to the corner girders 321-324. The baffles are attached to the girder linings. Thereafter the side panels 311-314 are bolted to the corner girders 321-324 and to the heads 315, 316.

Figure 2:
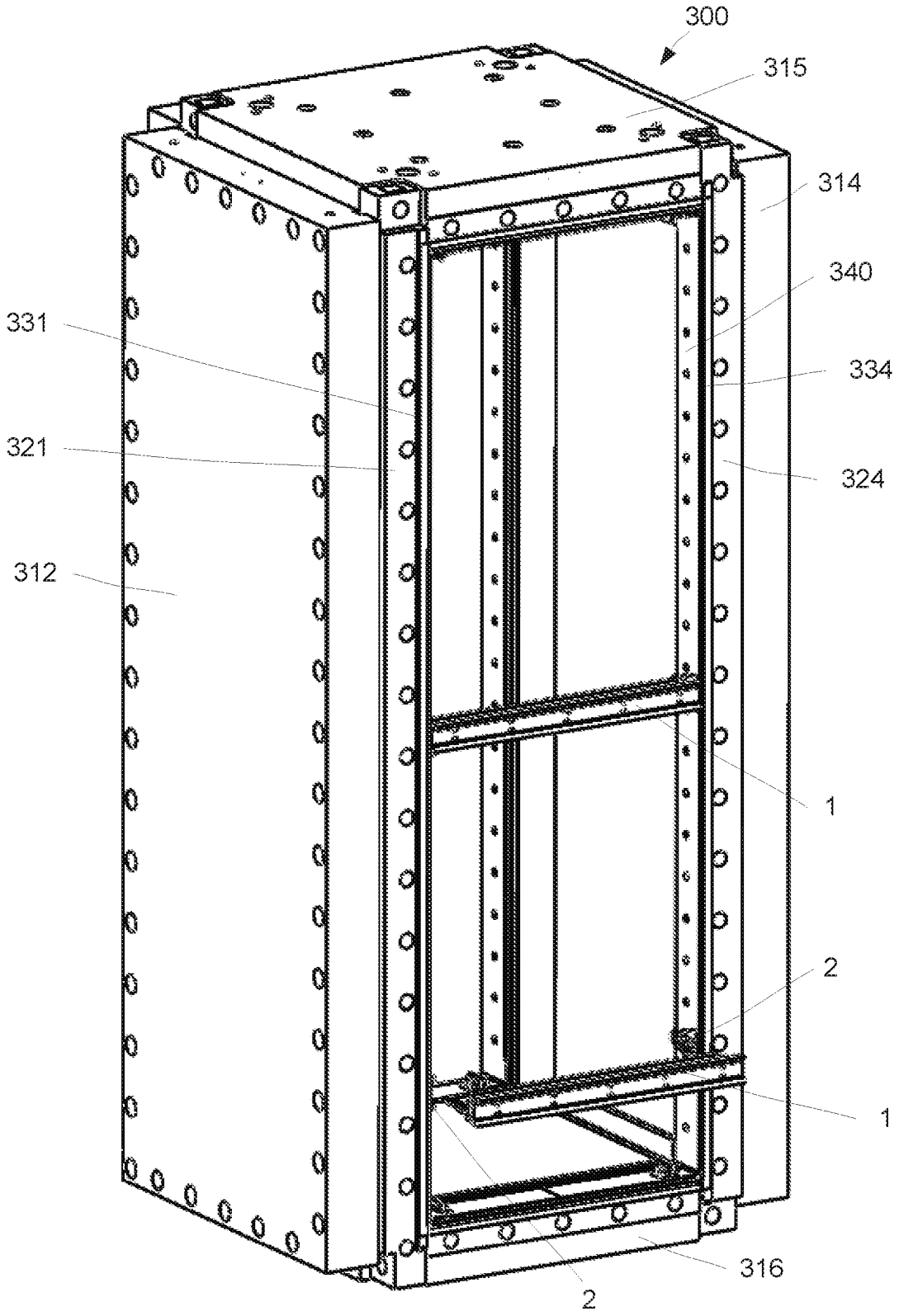
FIG. 2 is a perspective view of a block-type heat exchanger with an embodiment of baffle assemblies with a baffle and a baffle support according to the present invention.
Figure 3:
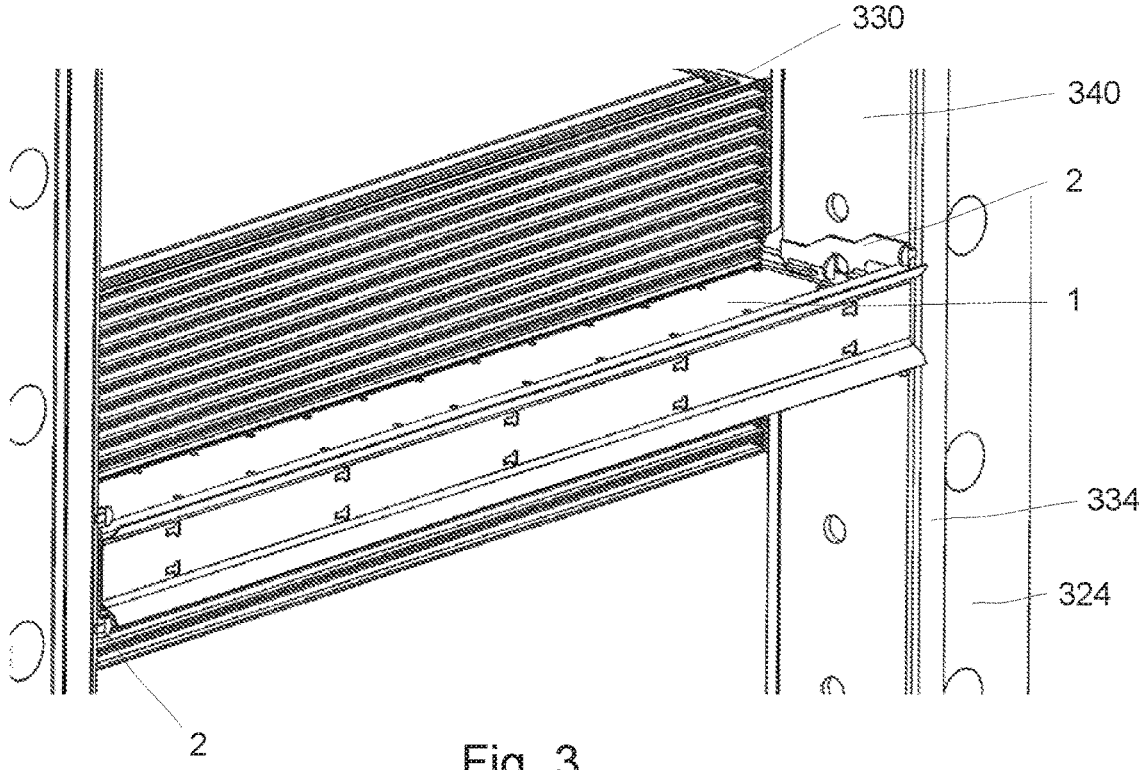
FIG. 3 is a perspective view of a detail of the block-type heat exchanger of FIG. 2 with the embodiment of a baffle assembly shown in FIG. 2.
Figure 4:
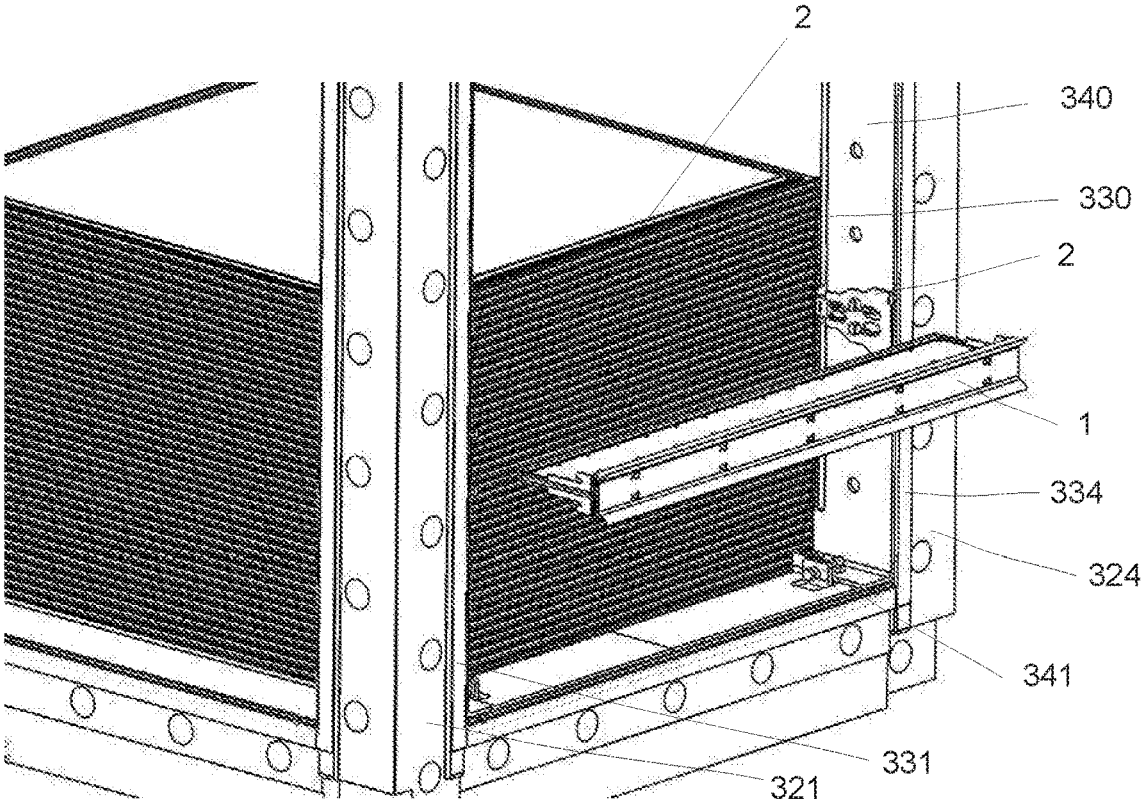
FIG. 4 is a perspective view of another detail of the block-type heat exchanger of FIG. 2 with the embodiment of a baffle assembly shown in FIG. 2, where the baffle is withdrawn from the baffle support.

Referring to FIGS. 2-4, a block-type plate heat exchanger of the type shown in FIG. 1, but with a new type of baffle assembly comprising a baffle 1 attached by means of baffle supports 2, is disclosed. In addition to the plate heat exchanger of FIG. 1, the plate heat exchanger of FIGS. 2-4 also discloses a vacuum cage 340 provided next to the girder linings (the girder linings 331, 334 as shown in the figures) in a space formed between the stack of heat transfer plates 330 and the side panel (the side panel 311 as shown in the figures). The space if defined by the stack of heat transfer plates 330, the side panel (the side panel 311 as shown in the figures) and the girder linings (the girder linings 331, 334 as shown in the figures). The vacuum cage 340 is fastened to the heads 315, 316 by fastening means 341.

In FIGS. 2-4, some of the heat transfer plates have been removed for better visibility. In FIG. 2 also the side panel 311 has been removed and the side panel 312 is shown without inlet 343 and outlet 344. In FIG. 4 all side panels have been removed.

Figure 5:
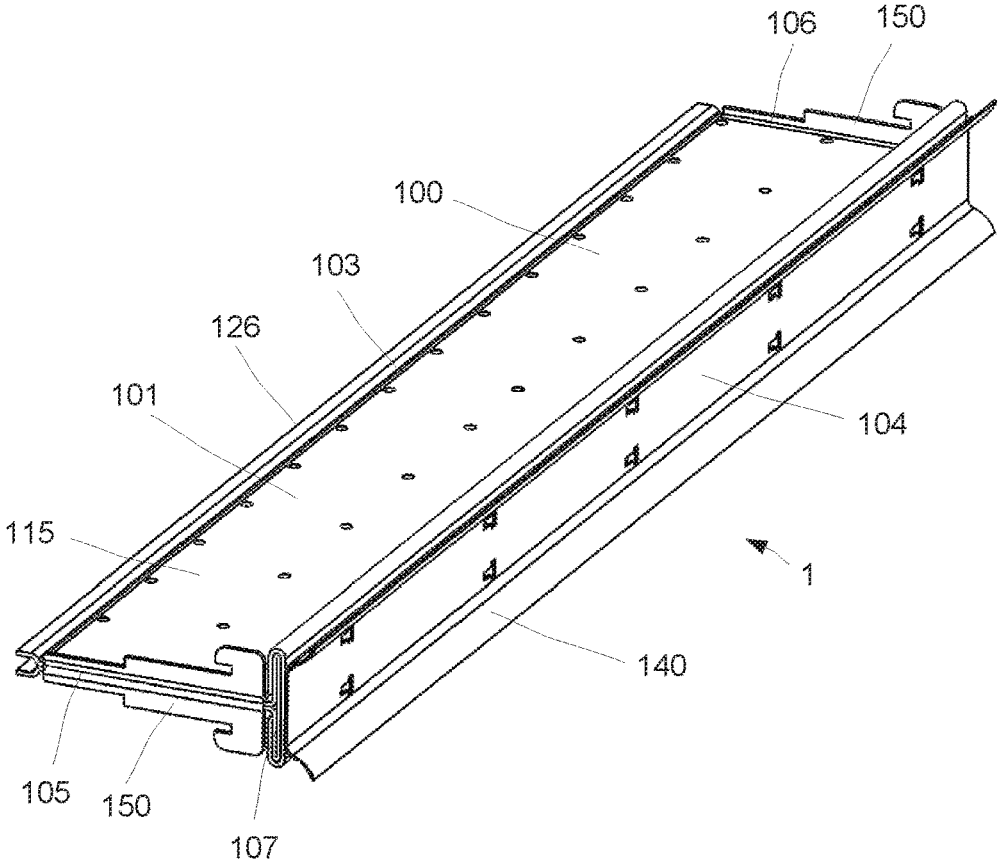
FIG. 5 is a perspective view of the embodiment of a baffle shown in FIGS. 2-4.
Figure 6:
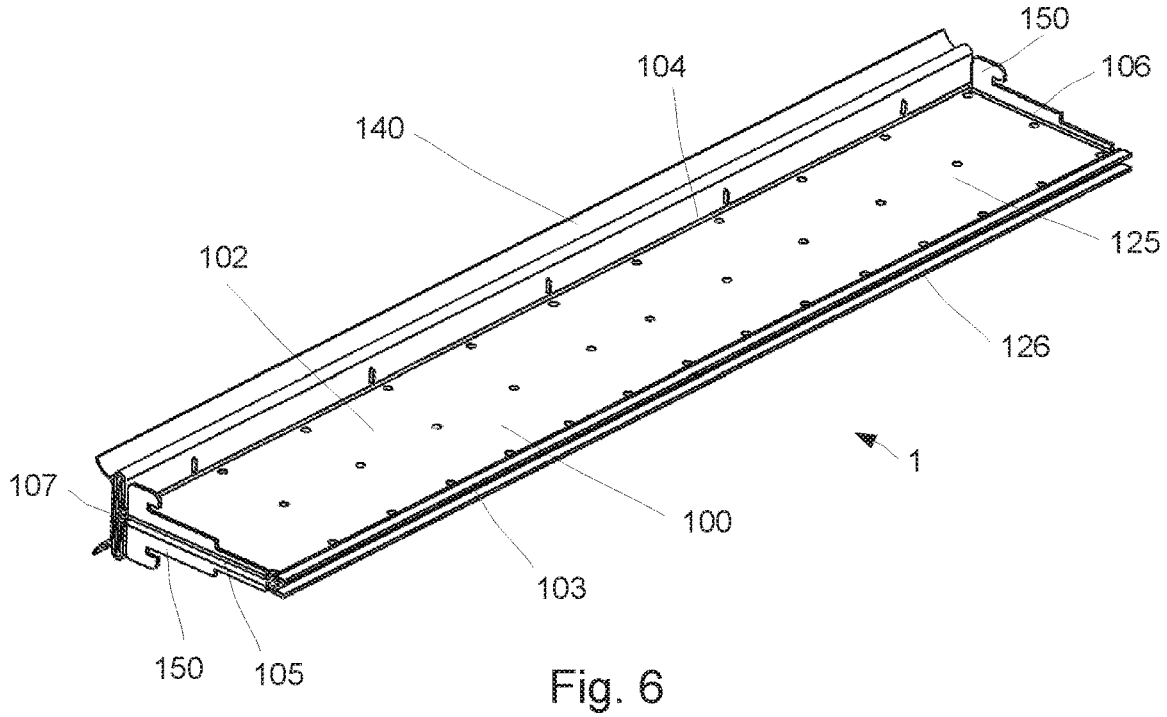
FIG. 6 is another perspective view of the embodiment of a baffle shown in FIGS. 2-5.
Figure 7:
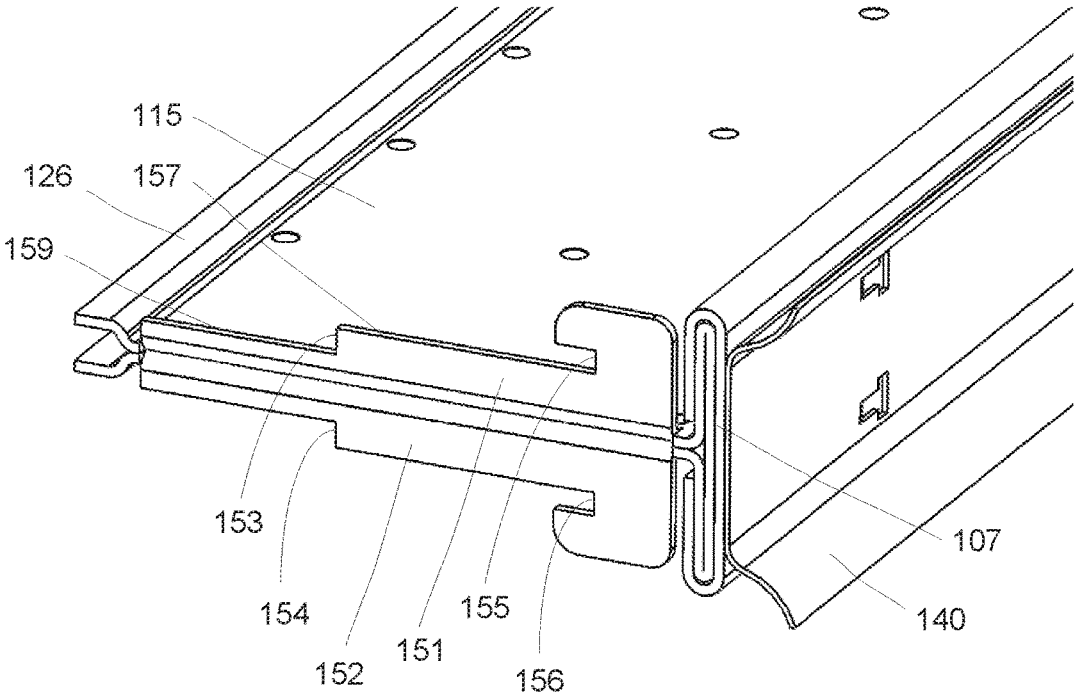
FIG. 7 is a perspective view of a detail of the embodiment of a baffle shown in FIGS. 2-6.
Figure 8:
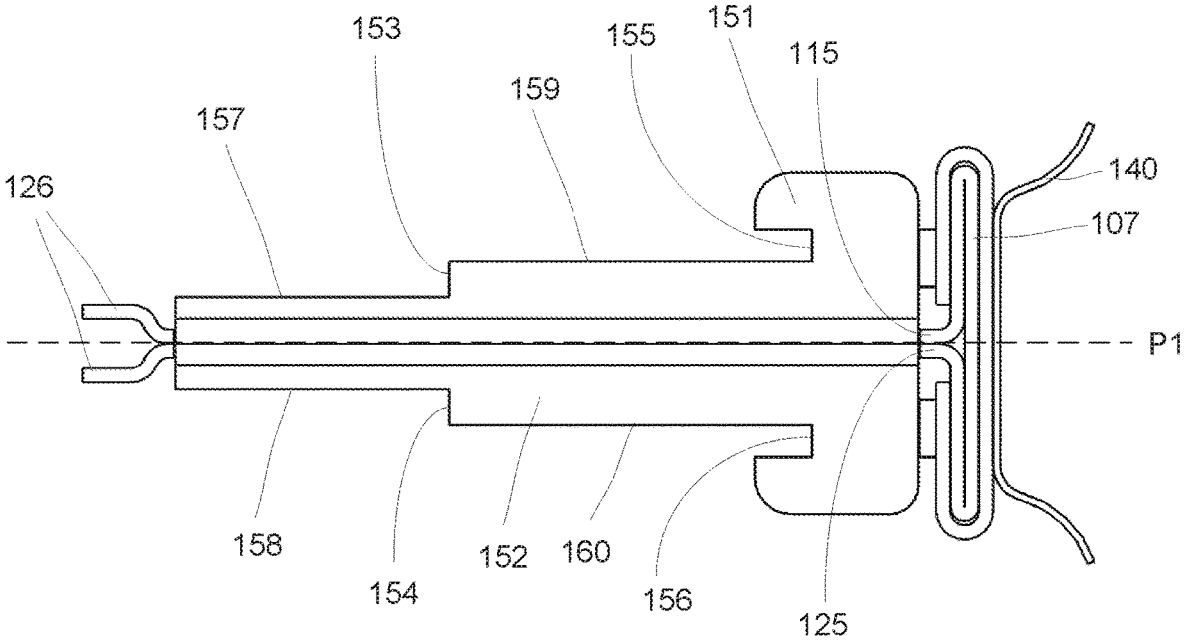
FIG. 8 is a side view of the embodiment of a baffle shown in FIGS. 2-7.

Referring to FIGS. 5-8, the baffle comprises a baffle plate 100. The baffle plate 100 comprises a first surface 101, which also can be denoted first baffle surface 101, and a second surface 102, which also can be denoted second baffle surface 102. FIG. 5 shows the upper side of the baffle, while FIG. 6 shows the lower side of the baffle.

The baffle plate 100 comprises a first sheet 115 and a second sheet 125. The first sheet 115 has the first surface 101 and the second sheet 125 has the second surface 102. The first surface 101 and the second surface 102 are facing in opposite directions. The first sheet 115 and the second sheet 125 are at least partially contacting each other. The first sheet 115 has a back surface on the opposite side of the first sheet 115 as the first surface 101 and the second sheet 125 has a back surface on the opposite side of the second sheet 125 as the second surface 102. The back surface of the first sheet 115 and the back surface of the second sheet 125 are facing each other and at least partly contacting each other. The first sheet 115 and the second sheet 125 are arranged parallel to and next to each other. The first sheet 115 and the second sheet 125 are parallel to a baffle plane P1 coinciding with the contacting plane between the first sheet 115 and the second sheet 125. The first sheet 115 and the second sheet 125 are welded, such as spot welded, to each other. The first sheet 115 and the second sheet 125 are at least in contact with each other at the locations of the spot welds.

The first surface 101 and the second surface 102 are parallel to the baffle plane P1. The baffle plane P1 is located between the first surface 101 and the second surface 102. The baffle plane P1 is parallel to the first surface 101 and the second surface 102.

The baffle plate 100 comprises a first longitudinal edge 103, a second longitudinal edge 104, a first transverse edge 105 and a second transverse edge 106. The first longitudinal edge 103 faces the stack of heat transfer plates 330. The second longitudinal edge 104 faces a side panel (the side panel 311 as shown in the figures, or any of the side panels 312, 313, 314 depending on which side of the stack of heat transfer plates the baffle is mounted). The first transverse edge 105 faces a girder lining (the girder lining 331 as shown in the figures) and the second transverse edge 106 faces another girder lining (the girder lining 334 s shown in the figures). The first transverse edge 105 as well as the second transverse edge 106 connects the first longitudinal edge 103 with the second longitudinal edge 104.

The baffle comprises an engagement means 126 for engagement of the heat transfer plates. The engagement means is located at the first longitudinal edge 103. The engagement means is a fork-shaped or crotch-shaped portion 126. The engagement means is formed by bending the first sheet 115 and the second sheet 125 such that a fork-shaped portion 126 is formed together by the first and the second sheet. Consequently, each of the first sheet 115 and the second sheet 125 has a bend, which may be denoted fork bend, together forming a fork-shape for engaging the heat transfer plates. The fork-shaped portion 126 seals against the stack of heat transfer plates and prevents leakage between passes of the flow path.

The baffle comprises a resilient member 140 at the second longitudinal edge 104. The resilient member 140 resiliently abuts the side panel (the side panel 311 as shown in the figures). Thereby, the resilient member 140 seals against the side panel and prevents flow past the baffle and between the passes of the heat exchanger. The resilient member secures that the baffle is pushed adequately against the baffle support and is held in an appropriate position. The resilient member may be attached to a reinforcement 107 at the second longitudinal edge 104 or formed by folding each of the first sheet 115 and the second sheet 125 along the second longitudinal edge 104 such that folds folded somewhat less than 90° are formed in a conventional manner. The resilient member 140 extends along at least a majority of the second longitudinal edge 104, preferably along at least 80% of the second longitudinal edge, more preferred along at least 90% of the second longitudinal edge, and most preferred along substantially all of the second longitudinal edge 104.

The baffle comprises a mounting member (baffle mount) 150 at each transverse edge 105, 106 for mounting the baffle 1 to a baffle support. Each mounting member 150 comprises at least one stop surface 153, 154, 155, 156 facing the first longitudinal edge 103. The stop surface 153, 154, 155, 156 prevents movement of the baffle, i.e. movement towards the stack of heat transfer plates. The stop surface 153, 154, 155, 156 prevents further movement of the baffle, i.e. further movement of the baffle than until the baffle, i.e. the stop surface 153, 154, 155, 156 of the baffle, abuts the first abutment surface 213, 214, 223, 224 of the baffle support detailed below.

Preferably, each mounting member 150 comprises at least two stop surfaces 153, 154, 155, 156 facing the first longitudinal edge 103. This improves the reliability and improves the prevention of movement of the baffle.

Each mounting member 150 comprises a first wing 151 extending from the first baffle surface 101 and a second wing 152 extending from the second baffle surface 102. Each of the first wing 151 and the second wing 152 comprises at least one stop surface 153, 154, 155, 156. The first wing 151 extends substantially perpendicular from the first baffle surface 101. The second wing 152 extends substantially perpendicular from the second baffle surface 102. The first wing 151 is formed by bending the first sheet 115 at a transverse edge 105, 106. The second wing 152 is formed by bending the second sheet 125 at a transverse edge 105, 106.

Preferably, each of the first wing 151 and the second wing 152 comprises a first stop surface 153, 154 and a second stop surface 155, 156. Thereby, the reliability and the prevention of further movement of the baffle is improved. The first wing 151 comprises the first stop surface 153 and the second stop surface 155. The second wing 152 comprises the first stop surface 154 and the second stop surface 156.

Each mounting member 150 comprises at least one primary blocking surface 157, 159 facing away from the first baffle surface 101 and at least one secondary blocking surface 158, 160 facing away from the second baffle surface 102. The blocking surfaces blocks movement of the baffle in the direction perpendicular to the first baffle surface 101 and the second baffle surface 102. The first wing 151 comprises said at least one primary blocking surface 157, 159. The second wing 152 comprises said at least one secondary blocking surface 158, 160. Preferably, each mounting member 150 comprises at least two primary blocking surfaces 157, 159 and at least two secondary blocking surfaces 158, 160. The first wing 151 comprises at least two primary blocking surfaces 157, 159. The first wing 151 comprises a first primary blocking surface 157 and a second primary blocking surface 159. The second wing 152 comprises at least two secondary blocking surface 158, 160. The second wing 152 comprises a first secondary blocking surface 158 and a second secondary blocking surface 160.

The stop surface 153, 154, 155, 156 is provided at an edge of the respective wing 151, 152. The stop surface 153, 154, 155, 156 is the edge of the respective wing 151, 152. The width of the stop surface 153, 154, 155, 156 is the same as the thickness of the respective wing 151, 152, i.e. the same as the thickness of the first sheet 115 and the second sheet 125, respectively.

The primary blocking surface 157, 159 is provided at an edge of the first wing 151. The primary blocking surface 157, 159 is the edge of the first wing 151. The width of the primary blocking surface 157, 159 is the same as the thickness of the first wing 151, i.e. the same as the thickness of the first sheet 115. The secondary blocking surface 158, 160 is provided at an edge of the second wing 152. The secondary blocking surface 158, 160 is the edge of the second wing 152. The width of the secondary blocking surface 158, 160 is the same as the thickness of the second wing 152, i.e. the same as the thickness of the second sheet 125.

The baffle 1 is held by two baffle supports 2. Each baffle support 2 is attached to an inner side wall. The inner side wall is a side wall of the space formed between the stack of heat transfer plates 330 and the side panel (the side panel 311 as shown in the figures). The inner side wall comprises the girder linings (the girder linings 331, 334 as shown in the figures). The baffle support 2 may be directly attached to the girder linings (the girder linings 331, 334 as shown in the figures) by welding or by fastening means such as bolts or screws fastened to the girder linings (the girder linings 331, 334 as shown in the figures) or the girders (the girders 321, 324 as shown in the figures). Alternatively, the baffle support 2 may be indirectly attached to the girder linings (the girder linings 331, 334 as shown in the figures). The baffle support may be attached to a vacuum cage 340 provided next to the girder lining in the space between the stack of heat transfer plates 330 and the side panel (the side panel 311 as shown in the figures) by welding or by fastening means.

Figure 9:
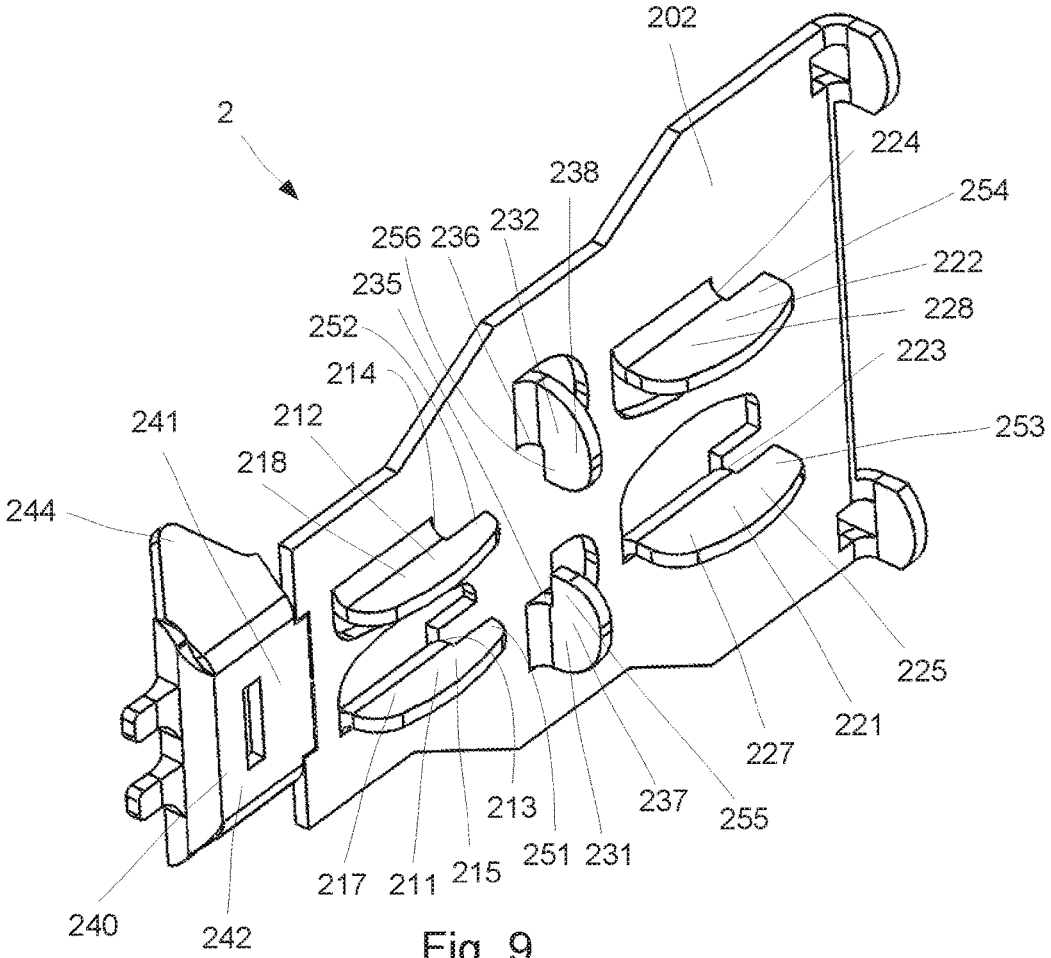
FIG. 9 is a frontside perspective view of the embodiment of a baffle support shown in FIGS. 2-4.
Figure 10:
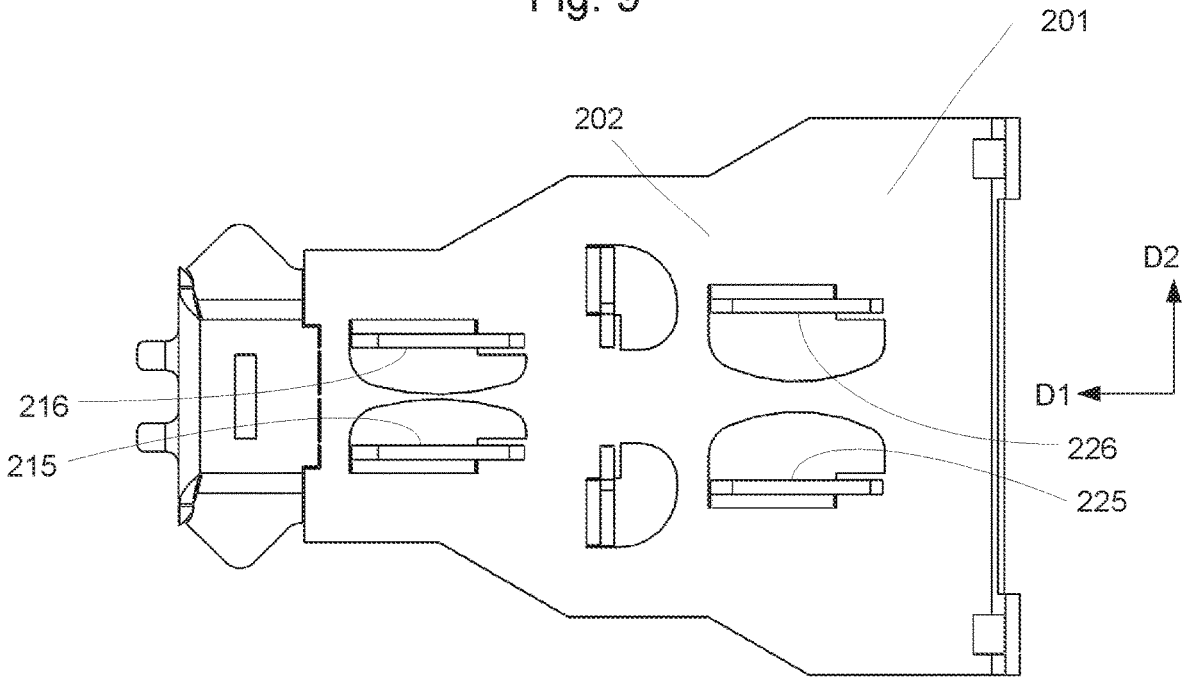
FIG. 10 is a front view of the embodiment of a baffle support shown in FIGS. 2-4 and 9.
Figure 11:
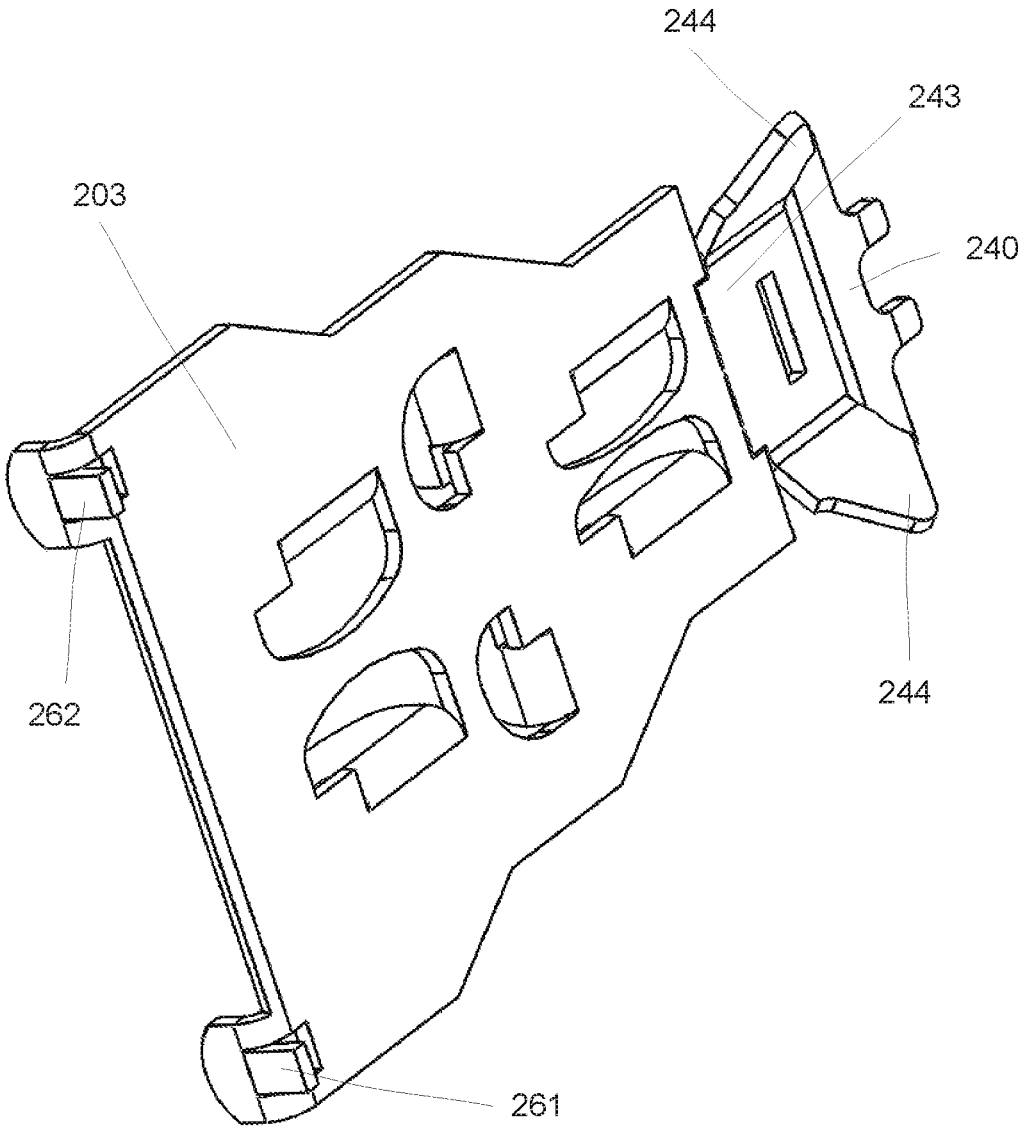
FIG. 11 is a backside perspective view of the embodiment of a baffle support shown in FIGS. 2-4 and 9-10.

Referring to FIGS. 9-11, the baffle support 2 comprises a base plate 201. The base plate 201 defines a base plane extending in a first direction D1 and a second direction D2. The second direction D2 is transverse to the first direction D1. The first direction D1 is in the direction towards the stack of heat transfer plates, i.e. towards the inner of the heat exchanger. The second direction is in the direction of the top head 315 or the bottom head 316 depending on which side of the space between the stack of heat transfer plates and the side panel the baffle support is located, i.e. depending on if the baffle support is attached to the "right" girder lining (the girder lining 334 as shown in the figures) or the "left" girder lining (the girder lining 331 as shown in the figures).

The base plate 201 has a front surface 202 and a back surface 203. The front surface 202 faces the space between the stack of heat transfer plates 330 and the side panel (the side panel 311 as shown in the figures) as well as the baffle 1. The back surface 203 faces the girder lining (the girder lining 331 or 334 as shown in the figures) as well as the vacuum cage 340 to which the baffle support is attached.

The baffle support 2 comprises a first pair of projections 211, 212 extending from the front surface 202 of the base plate 201 to engage the baffle. The baffle support also comprises a second pair of projections 221, 222; 231, 232 also extending from the front surface 202 of the base plate 201 to engage the baffle. The first pair of projections 211, 212 is located further in the first direction D1 than the second pair of projections 221, 222; 231, 232. Thereby, the baffle is accurately held in place and the baffle, more precisely the baffle plate 100, is held with the desired orientation, preferably parallel to the top head 315 as well as the bottom head 316.

The baffle support shown in FIGS. 9-11 has a first, alternatively denoted primary, pair of projections 211, 212 as well as a secondary pair of projections 221, 222 and a tertiary pair of projections 231, 232, which secondary pair of projections 221, 222 and tertiary pair of projections 231, 232 corresponds to the second pair of projections. The first pair of projections 211, 212 is located further in the first direction than both the secondary pair of projections 221, 222 and the tertiary pair of projections 231, 232. As shown in FIGS. 9-11, the tertiary pair of projections 231, 232 is located further in the first direction than the secondary pair of projections 221, 222.

At least one of the projections 211, 212, 221, 222 comprises a first abutment surface 213, 214, 223, 224 facing in a direction opposite the first direction D1 for abutting the baffle and preventing movement of the baffle in the first direction D1. By limiting the movement of the baffle in the first direction, the baffle, in particular the fork-shaped portion 126 thereof engaging the heat transfer plates, will not deform and destroy the heat transfer plates, which for example may cause leakage between the fluid paths and thus contamination. The first abutment surface 213, 214, 223, 224 prevents further movement of the baffle in the first direction, i.e. further movement of the baffle than until the baffle, i.e. the stop surface 153, 154, 155, 156 of the baffle, abuts the first abutment surface. The first abutment surface 213, 214, 223, 224 prevents movement of the baffle towards the stack of heat transfer plates.

Preferably, at least two of the projections 211, 212, 221, 222 comprise a first abutment surface 213, 214, 223, 224 facing in a direction opposite the first direction D1 for abutting the baffle and blocking movement of the baffle in the first direction D1. More preferred, at least one of the projections of the first pair of projections 211, 212 and at least one of the projections of the second pair of projections 221, 222 comprise a first abutment surface 213, 214, 223, 224 facing in a direction opposite the first direction D1 for abutting the baffle and preventing movement of the baffle in the first direction D1. Even more preferred, both projections of the first pair of projections 211, 212 and both projections of the second pair of projections 221, 222 comprise a first abutment surface 213, 214, 223, 224 facing in a direction opposite the first direction D1 for abutting the baffle and preventing movement of the baffle in the first direction D1. In the baffle support shown in FIGS. 9-11, both projections of the first pair of projections 211, 212 comprise a first abutment surface 213, 214 facing in a direction opposite the first direction D1 and both projections of the secondary pair of projections 221, 222 comprise a first abutment surface 223, 224 facing in a direction opposite the first direction D1 for abutting the baffle and preventing movement of the baffle in the first direction D1. The projection 211 of the first pair of projections 211, 212 comprises the first abutment surface 213. The projection 212 of the first pair of projections 211, 212 comprises the first abutment surface 214. The projection 221 of the secondary pair of projections 221, 222 comprises the first abutment surface 223. The projection 222 of the secondary pair of projections 221, 222 comprises the first abutment surface 224.

The first abutment surfaces 213, 214, 223, 224 interact with the stop surfaces 153, 154, 155, 156 by abutment. The first abutment surfaces 213, 214 of the first pair of projections 211, 212 interact with the first stop surfaces 153, 154. The first abutment surfaces 223, 224 of the secondary pair of projections 221, 222 interact with the second stop surfaces 155, 156.

The first abutment surface 213 of the projection 211 of the first pair of projections 211, 212 abuts the first stop surface 153 of the first wing 151. The first abutment surface 214 of the projection 212 of the first pair of projections 211, 212 abuts the first stop surface 154 of the second wing 152. The first abutment surface 223 of the projection 221 of the secondary pair of projections 221, 222 abuts the second stop surface 155 of the first wing 151. The first abutment surface 224 of the projection 222 of the secondary pair of projections 221, 222 abuts the second stop surface 156 of the second wing 152.

Both projections of at least one of the pairs of projections 211, 212; 221, 222; 231, 232 comprise a second abutment surface 215, 216, 225, 226, 235, 236. The second abutment surfaces 215, 216; 225, 226; 235, 236 of the same pair of projections face each other for blocking movement of the baffle in the second direction D2 and a direction opposite the second direction D2. Preferably, both projections of at least two of the pairs of projections 211, 212; 221, 222; 231, 232 comprise a second abutment surface 215, 216, 225, 226, 235, 236. Thereby, tilting and rotation of the baffle is prevented. In the baffle support shown in FIGS. 9-11, both projections 211, 212 of the first pair of projections 211, 212 comprise a second abutment surface 215, 216, both projections 221, 222 of the secondary pair of projections 221, 222 comprise a second abutment surface 225, 226 and both projections 231, 232 of the tertiary pair of projections 231, 232 comprise a second abutment surface 235, 236.

The projection 211 of the first pair of projections 211, 212 comprises the second abutment surface 215. The projection 212 of the first pair of projections 211, 212 comprises the second abutment surface 216. The second abutment surfaces 215, 216 face each other. The projection 221 of the secondary pair of projections 221, 222 comprises the second abutment surface 225. The projection 222 of the secondary pair of projections 221, 222 comprises the second abutment surface 226. The second abutment surfaces 225, 226 face each other. The projection 231 of the tertiary pair of projections 231, 232 comprises the second abutment surface 235. The projection 232 of the tertiary pair of projections 231, 232 comprises the second abutment surface 236. The second abutment surfaces 235, 236 face each other.

The second abutment surface abuts the baffle or the distance between second abutment surfaces of the projections of the pair of projections having the second abutment surfaces is slightly larger than the thickness of the baffle at the location where it is engaged by the projections. In case the second abutment surfaces abut the baffle, the distance between second abutment surfaces of the projections of the pair of projections having the second abutment surfaces is substantially identical to the thickness of the baffle at the location where it is engaged by the projections. The distance between the second abutment surfaces is be substantially identical to or slightly larger than the total height of the wings at the location where the baffle is engaged by the projections. More precisely, the distance between the second abutment surfaces is be substantially identical to or slightly larger than the distance between the first blocking surface and the second blocking surface at the location where the baffle is engaged by the projections. In particular, the distance between the second abutment surfaces 215, 216 of the first pair of projections 211, 212 is be identical to or slightly larger than the distance between the first primary blocking surface 157 and the first secondary blocking surface 158. The distance between the second abutment surfaces 225, 226 of the secondary pair of projections 221, 222 is be identical to or slightly larger than the distance between the second primary blocking surface 159 and the second secondary blocking surface 160. The distance between the second abutment surfaces 235, 236 of the tertiary pair of projections 231, 232 is be identical to or slightly larger than the distance between the second primary blocking surface 159 and the second secondary blocking surface 160. The distance between the second abutment surfaces 215, 216 of the first pair of projections 211, 212 is smaller than the distance between the second abutment surfaces 225, 226 of the secondary pair of projections 221, 222 as well as the distance between the second abutment surfaces 235, 236 of the tertiary pair of projections 231, 232. The distance between the second abutment surfaces 225, 226 of the secondary pair of projections 221, 222 is the same as the distance between the second abutment surfaces 235, 236 of the tertiary pair of projections 231, 232. Correspondingly, the distance between the first primary blocking surface 157 and the first secondary blocking surface 158 is smaller than the distance between the second primary blocking surface 159 and the second secondary blocking surface 160. Thereby, the baffle is easily retractable in the direction opposite the first direction D1 when the side panel (the side panel 311 as shown in the figures) is removed e.g. for maintenance.

The second abutment surfaces 215, 216, 225, 226, 235, 236 interact with the primary blocking surfaces 157, 159 and the secondary blocking surfaces 158, 160 by abutment or limiting the movement of the baffle in the second direction D2 and a direction opposite the second direction. The second abutment surfaces 215, 216 of the first pair of projections 211, 212 interact with the first primary blocking surface 157 and the first secondary blocking surface 158. The second abutment surfaces 225, 226 of the secondary pair of projections 221, 222 interact with the second primary blocking surface 159 and the second secondary blocking surface 160. The second abutment surfaces 235, 236 of the tertiary pair of projections 231, 232 interact with the second primary blocking surface 159 and the second secondary blocking surface 160.

The second abutment surface 215 of the projection 211 of the first pair of projections 211, 212 interact with the first primary blocking surface 157 of the first wing 151. The second abutment surface 216 of the projection 212 of the first pair of projections 211, 212 interact with the first secondary blocking surface 158 of the second wing 152. The second abutment surface 225 of the projection 221 of the secondary pair of projections 221, 222 interact with the second primary blocking surface 159 of the first wing 151. The second abutment surface 226 of the projection 222 of the secondary pair of projections 221, 222 interact with the second secondary blocking surface 160 of the second wing 152. The second abutment surface 235 of the projection 231 of the tertiary pair of projections 231, 232 interact with the second primary blocking surface 159 of the first wing 151. The second abutment surface 236 of the projection 232 of the tertiary pair of projections 231, 232 interact with the second secondary blocking surface 160 of the second wing 152.

The projections of the pairs of projections 211, 212; 221, 222 having the first abutment surface 213, 214, 223, 224 comprise a first projecting plate 217, 218, 227, 228 formed by bending a first portion of the base plate such that said first projecting plate 217, 218, 227, 228 extends along the first direction D1. Bending a portion of the base plate is an easy and inexpensive way of forming a projection. Having the projection bent from the base plate extending along the first direction gives a high strength and rigidity along the first direction and prevents deformation of the projection when subjected to forces in the first direction. This holds the baffle safely in position in the first direction and secures that the baffle not is moved further in the first direction than is defined by the first abutment surfaces. The projection 211 of the first pair of projections 211, 212 comprises the first projecting plate 217. The projection 212 of the first pair of projections 211, 212 comprises the first projecting plate 218. The projection 221 of the secondary pair of projections 221, 222 comprises the first projecting plate 227. The projection 222 of the secondary pair of projections 221, 222 comprises the first projecting plate 228. The first projecting plates 217, 218, 227, 228 are formed by cutting and bending a first portion of the base plate such that said first projecting plate 217, 218, 227, 228 extends along the first direction D1.

Each of the projections of at least one pair of the projections 231, 232 having the second abutment surface 235, 236 comprises a second projecting plate 237, 238 formed by bending a second portion of the base plate such that said second projecting plate 237, 238 extends along the second direction D2. As mentioned above, bending a portion of the base plate is an easy and inexpensive way of forming a projection. Analogously as above, having the projection bent from the base plate extending along the second direction gives a high strength and rigidity along the second direction and prevents deformation of the projection when subjected to forces in the second direction. This holds the baffle safely in position in the second direction and the direction opposite the second direction and thereby secures that the baffle not is moved in the second direction or the direction opposite the second direction. The projection 231 of the tertiary pair of projections 231, 232 comprises the second projecting plate 237. The projection 232 of the tertiary pair of projections 231, 232 comprises the second projecting plate 238. The second projecting plates 237, 238 are formed by cutting and bending a second portion of the base plate such that said second projecting plate 237, 238 extends along the second direction D2.

The contours of the projections (i.e. the outer contours of the projections except along the portion where the projections still are attached to the base plate) is cut in the base plate, e.g. by laser cutting. Then the projections are bent along the portion where the projections still are attached to the base plate such that the projections project substantially perpendicular from the front surface 202 of the base plate 201.

The first projecting plates 217, 218, 227, 228 comprises the first abutment surfaces 213, 214, 223, 224. The first projecting plate 217 comprises the first abutment surface 213. The first projecting plate 218 comprises the first abutment surface 214. The first projecting plate 227 comprises the first abutment surface 223. The first projecting plate 228 comprises the first abutment surface 224.

The first abutment surface 213, 214, 223, 224 is provided at an edge of the respective first projecting plate 217, 218, 227, 228. The first abutment surface 213, 214, 223, 224 is the edge of the respective first projecting plate 217, 218, 227, 228. The width of the first abutment surface 213, 214, 223, 224 is the same as the thickness of the respective first projecting plate 217, 218, 227, 228, i.e. the same as the thickness of the base plate 201.

The second projecting plates 237, 238 comprise the second abutment surfaces 235, 236. The second projecting plate 237 comprises the second abutment surface 235. The second projecting plate 238 comprises the second abutment surface 236.

The second abutment surface 235, 236 is provided at an edge of the respective second projecting plate 237, 238. The second abutment surface 235, 236 is the edge of the respective second projecting plate 237, 238. The width of the second abutment surface 235, 236 is the same as the thickness of the respective second projecting plate 237, 238, i.e. the same as the thickness of the base plate 201.

The projections 211, 212, 221, 222, 231, 232 comprise a hook 251, 252, 253, 254, 255, 256. The hooks 251, 252, 253, 254, 255, 256 engage the baffle, in particular the mounting member 150, more specifically the wings of the baffle. The projection 211 of the first pair of projections 211, 212 comprises the hook 251. The projection 212 of the first pair of projections 211, 212 comprises the hook 252. The projection 221 of the secondary pair of projections 221, 222 comprises the hook 253. The projection 222 of the secondary pair of projections 221, 222 comprises the hook 254. The projection 231 of the tertiary pair of projections 231, 232 comprises the hook 255. The projection 22 of the tertiary pair of projections 231, 232 comprises the hook 256.

The hook 251 engages the first wing 151 at the location of the first stop surface 153 of the first wing 151. The hook 252 engages the second wing 152 at the location of the first stop surface 154 of the second wing 152. The hook 253 engages the first wing 151 at the location of the second stop surface 155 of the first wing 151. The hook 254 engages the second wing 152 at the location of the second stop surface 156 of the second wing 152. The hook 255 engages the first wing 151 at the location of the second primary blocking surface 159 of the first wing 151. The hook 256 engages the second wing 152 at the location of the second secondary blocking surface 160 of the second wing 152.

The baffle support 2 comprises at least one corner projection 261, 262 extending from the back surface 203 of the base plate 201. The corner projection facilitates location and alignment of the baffle support and secures that the baffle support is attached to the inner side wall at the right place and with the correct orientation, typically with the first direction horizontally. The corner projection abuts the edge of the vacuum cage or the girder lining, i.e. the edge facing the side panel. The corner projection 261, 262 is located at an edge of the base plate 201 facing in a direction opposite the first direction D1, i.e. at an edge facing the side panel. Preferably, the baffle support comprises two corner projections 261, 262.

The corner projection 261, 262 comprises a corner plate formed by bending a portion of the base plate such the corner plate extends along the second direction D2. The corner plate is formed by cutting and bending a portion of the base plate such that the corner plate extends along the second direction D2.

The baffle support 2 comprises a locking member 240 comprising a locking plate 241 having a head surface 242 and a rear surface 243. The locking plate 241 comprises a protrusion 244 extending from the rear surface 243. The locking plate 241 is pivotably attached to the base plate 201 with an axis of pivoting along the second direction D2. The locking member 240, in particular the protrusion 244, blocks bypass along the girder lining next to the stack of heat transfer plates. The pivotability of the locking plate implies that the locking member is foldable. By pivoting the locking member 240 inwards towards the space formed between the stack of heat transfer plates and the side panel, the vacuum cage 340 is easily releasable (when the baffle support only is attached to a vacuum cage 340 e.g. by a weld) without separating the baffle support from the vacuum cage 340. By pivoting the locking member 240 outwards towards the girder lining, the protrusion 244 of the locking member blocks bypass. The locking plate 241 is pivotably attached to the base plate by means of a pin arranged along the second direction and inserted in holes of the locking plate 241 and the base plate 201. The head surface 242 can also be denoted a front surface and substantially corresponds to the front surface 202 of the base plate 201 in the mounted position of the locking member 240 shown in the FIGS. 2-4 and 9-11. The rear surface 243 can also be denoted a back surface and substantially corresponding to the back surface 203 of the base plate 201 in the mounted position of the locking member 240 shown in the FIGS. 2-4 and 9-11.

The baffle 1 itself as well as the mounting member 150, the fork-shaped portion 126 and the resilient member 140 are symmetrical with a mirror plane coinciding with the baffle plane P1. Also, the baffle support is symmetrical with a mirror plane coinciding with the baffle plane P1. The baffle is also symmetrical with a mirror plane extending from a midpoint of the first longitudinal edge 103 to a midpoint of the second longitudinal edge 104 and being perpendicular to the baffle plane P1.

The baffle is easily mounted to and releasable from the baffle support. When mounting the baffle, the baffle is inserted into the baffle support by moving the baffle in the first direction D1. The baffle is moved in the first direction D1 until the stop surfaces of the baffle abut the first abutment surfaces of the baffle support. The baffle may be held in the baffle support by only the side panel. The baffle is pushed against the first abutment surfaces of the baffle support by the side panel acting on the resilient member of the baffle. No further attachment of the baffle to the baffle support is necessary. The baffle is held in the second direction D2 and the direction opposite the second direction, typically in the vertical direction, by the pair of projections, in particular the second abutment surfaces of the pair of projections, by interaction between the second abutment surfaces of the baffle support and the blocking surfaces of the baffle. The baffle is easily retracted from the baffle support by moving the baffle in the direction opposite the first direction D1 once the side panel has been removed, e.g. for maintenance. The access to the interior of the heat exchanger such as to the stack of heat transfer plates is thereby improved.

The baffle and two baffle supports form part of a baffle assembly for a block-type heat exchanger. The baffle as well as the baffle supports of the baffle assembly may comprise any feature mentioned above.

A block-type heat exchanger may have two or more baffle assemblies on one side of the stack of heat transfer plates as shown in FIG. 2. One, two or more similar baffle assemblies may be arranged on other sides, preferably the opposite side, and more preferred all sides, of the stack of heat transfer plates in the same way as is visualized in FIG. 1.

The foregoing has described the principles, preferred embodiments, aspects and modes of operation of the present invention. However, the description should be regarded as illustrative rather than restrictive, and the invention should not be limited to the particular embodiments and versions discussed above. The different features of the various embodiments and versions of the invention can be combined in other combinations than those explicitly described. It should therefore be appreciated that variations may be made in those embodiments and versions by those skilled in the art without departing from the scope of the present invention as defined by the following claims.

The invention claimed is:

1. A baffle support arranged to be attached to an inner side wall of a block-type heat exchanger for holding a baffle in the heat exchanger, the baffle support comprising a base plate defining a base plane extending in a first direction and a second direction transverse to the first direction, the base plate having a front surface and a back surface, the base plate also having an outer periphery, the baffle support comprising a first pair of projections extending from the front surface of the base plate to engage the baffle and a second pair of projections extending from the front surface of the base plate to engage the baffle, wherein the first pair of projections is located further in the first direction than the second pair of projections, each of the projections of the first pair of projections possessing an outer surface facing towards the outer periphery of the base plate so that the outer surfaces of the first pair of projections face away from each other, the outer surfaces of the first pair of projections being spaced from the outer periphery of the base plate so that a portion of the front surface exists between the outer periphery of the base plate and the outer surface of each of the first pair of projections, each of the projections of the second pair of projections possessing an outer surface facing towards the outer periphery of the base plate so that the outer surfaces of the second pair of projections face away from each other, the outer surfaces of the second pair of projections being spaced from the outer periphery of the base plate so that a portion of the front surface exists between the outer periphery of the base plate and the outer surface of each of the second pair of projections.

2. A baffle support according to claim 1, wherein at least one of the projections comprises a first abutment surface facing in a direction opposite the first direction for abutting the baffle and preventing movement of the baffle in the first direction.

3. A baffle support according to claim 2, wherein at least two of the projections comprise a first abutment surface facing in a direction opposite the first direction for abutting the baffle and preventing movement of the baffle in the first direction.

4. A baffle support according to claim 2, wherein at least one of the projections of the first pair of projections and at least one of the projections of the second pair of projections comprise a first abutment surface facing in a direction opposite the first direction for abutting the baffle and preventing movement of the baffle in the first direction.

5. A baffle support according to claim 2, wherein the projection(s) of the pair(s) of projections having the first abutment surface comprises a first projecting plate formed by bending a first portion of the base plate such that said first projecting plate extends along the first direction.

6. A baffle support according to claim 1, wherein both projections of at least one of the pairs of projections comprise an abutment surface, wherein the abutment surfaces of the same pair of projections face each other for blocking movement of the baffle in the second direction and a direction opposite the second direction.

7. A baffle support according to claim 6, wherein each of the projections of at least one pair of the projections having the abutment surface comprises a projecting plate formed by bending a portion of the base plate such that said projecting plate extends along the second direction.

8. A baffle support according to claim 1, wherein the baffle support comprises a locking member comprising a locking plate having a head surface and a rear surface, wherein the locking plate comprises a protrusion extending from the rear surface, wherein the locking plate is pivotably attached to the base plate with a pivot axis along the second direction.

9. A baffle assembly for a block-type heat exchanger comprising two of the baffle supports according to claim 1 and a baffle comprised of a baffle plate comprising a first baffle surface and a second baffle surface, the baffle plate comprising a first longitudinal edge, a second longitudinal edge, a first transverse edge and a second transverse edge, the baffle comprising a baffle mount at each transverse edge for mounting the baffle to a baffle support, each baffle mount comprising at least one stop surface facing the first longitudinal edge.

10. A baffle support according to claim 1, wherein each of the first pair of projections and each of the second pair of projections is a plate constituted by a portion of the base plate being cut-out and bent so that a respective through hole exists in the base plate immediately adjacent each of the first pair of projections and each of the second pair of projections.

11. A baffle for a block-type heat exchanger comprising a baffle plate comprising a first baffle surface and a second baffle surface, the baffle plate comprising a first longitudinal edge, a second longitudinal edge, a first transverse edge and a second transverse edge, the baffle comprising a baffle mount at each transverse edge for mounting the baffle to a baffle support, each baffle mount comprising at least two stop surfaces facing the first longitudinal edge, each baffle mount also comprising a first wing extending from the first baffle surface and a second wing extending from the second baffle surface, wherein the first wing comprises one of the at least two stop surfaces and the second wing comprises another one of the at least two stop surfaces.

12. A baffle according to claim 11, wherein the at least two stop surfaces include two first stop surfaces and two second stop surfaces, each of the first wing and the second wing comprises one of the first stop surfaces and one of the second stop surfaces.

13. A baffle according to claim 11, wherein each baffle mount comprises at least one primary blocking surface facing away from the first baffle surface and at least one secondary blocking surface facing away from the second baffle surface.

14. A baffle according to claim 13, wherein the first wing comprises said at least one primary blocking surface and the second wing comprises said at least one secondary blocking surface.

15. A baffle support arranged to be attached to an inner side wall of a block-type heat exchanger for holding a baffle in the heat exchanger, the baffle support comprising a base plate defining a base plane extending in a first direction and a second direction transverse to the first direction, the base plate having a front surface and a back surface, the baffle support comprising a first pair of projections extending from the front surface of the base plate to engage the baffle and a second pair of projections extending from the front surface of the base plate to engage the baffle, wherein the first pair of projections is located further in the first direction than the second pair of projections, each of the projections of the first pair of projections possessing an abutment surface configured to abut respective first surfaces of the baffle when the baffle is held by the baffle support, the abutment surfaces of the first pair of projections facing each other, each of the projections of the second pair of projections possessing an abutment surface configured to abut respective second surfaces of the baffle when the baffle is held by the baffle support, the abutment surfaces of the second pair of projections facing each other, the abutment surfaces of the first pair of projections being spaced apart by a first distance, the abutment surfaces of the second pair of projections being spaced apart by a second distance, the first and second distances being different.

16. A baffle support according to claim 15, wherein the second distance is greater than the first distance.

17. A baffle support according to claim 15, wherein each projection of the first pair of projections and each projection of the second pair of projections includes a hook configured to engage a respective stop surface on the baffle when the baffle is held by the baffle support, each hook overlying the front surface of the base plate and being spaced from the front surface of the base plate.

18. A baffle support arranged to be attached to an inner side wall of a block-type heat exchanger for holding a baffle in the heat exchanger, the baffle support comprising a base plate defining a base plane extending in a first direction and a second direction transverse to the first direction, the base plate having a front surface and a back surface, the baffle support comprising a first pair of projections extending from the front surface of the base plate to engage the baffle and a second pair of projections extending from the front surface of the base plate to engage the baffle, wherein the first pair of projections is located further in the first direction than the second pair of projections, at least one of the projections of the first pair of projections and at least one of the projections of the second pair of projections comprise a first abutment surface facing in a direction opposite the first direction for abutting the baffle and preventing movement of the baffle in the first direction.

19. A baffle support arranged to be attached to an inner side wall of a block-type heat exchanger for holding a baffle in the heat exchanger, the baffle support comprising a base plate defining a base plane extending in a first direction and a second direction transverse to the first direction, the base plate having a front surface and a back surface, the baffle support comprising a first pair of projections extending from the front surface of the base plate to engage the baffle and a second pair of projections extending from the front surface of the base plate to engage the baffle, wherein the first pair of projections is located further in the first direction than the second pair of projections, the baffle support also comprising a locking member that comprises a locking plate having a head surface and a rear surface, wherein the locking plate comprises a protrusion extending from the rear surface, wherein the locking plate is pivotably attached to the base plate with a pivot axis along the second direction.

* * * * *